United States Patent [19]

Ross

[11] 4,033,654

[45] July 5, 1977

[54] ELECTRICAL CONNECTOR

[75] Inventor: Harold B. Ross, Canoga Park, Calif.

[73] Assignee: Automation Industries, Inc., Century City, Calif.

[22] Filed: July 29, 1976

[21] Appl. No.: 709,584

[52] U.S. Cl. ..... 339/143 R; 339/256 RT

[51] Int. Cl.[2] ..... H01R 13/34

[58] Field of Search ..... 339/143 R, 143 C, 90 R, 339/94 R, 255 RT, 256 RT, 177 R

[56] References Cited

UNITED STATES PATENTS

| | | | |
|---|---|---|---|
| 2,953,628 | 9/1960 | Winter et al. | 339/143 C |
| 3,087,038 | 4/1963 | Bethke | 339/255 RT X |
| 3,739,076 | 6/1973 | Schwartz | 339/177 R |
| 3,835,443 | 9/1974 | Arnold et al. | 339/143 R |

*Primary Examiner*—Roy Lake
*Assistant Examiner*—E. F. Desmond
*Attorney, Agent, or Firm*—Thomas L. Flattery

[57] ABSTRACT

An electrical connector and method for providing an electrical connection wherein a receptacle having a current-carrying cable is insertible into a plug having a current-carrying cable and the cables are interconnected providing electrical connection therebetween. An endless spring coil of circular form having closely spaced turns each at an angle to its tangent to the circular form, when uncompressed, is inserted into an annular groove on the plug prior to insertion of the receptacle. When the receptacle is inserted into the plug, the coil is radially compressed thereby reducing the spacing between the turns and increasing their slant and wiping the coil along the contacting surfaces of the plug and receptacle to present the electrical effect of a solid coil and to minimize radio frequency and electromagnetic interferences.

2 Claims, 8 Drawing Figures

-17-
-12-
11
13
14
15
16
18
19
20
20'
21
22
23
24
25
26
VII
III
IV
X
Y

ELECTRICAL CONNECTOR

BACKGROUND

At the present time, there are a large variety of different types of connectors for joining the individual wires of a first cable with the individual wires of a second cable. Most of the connectors are satisfactory for the applications for which they are designed. However, many of them have limitations which reduce their usefulness and prevent or severely restrict their use in other applications.

One problem frequently encountered is the interference of such connectors from radio frequency signals (RFI) and electromagnetic signals (EMI). Prior art connectors have had electrical leakage problems through the grounding rings used to prevent interference of relatively low frequencies. Also, some prior art interference shielding devices require intricate installation, soldering, etc. and are prone to damage in both factory and field operation. If stray EMI and RFI signals penetrate such electrical connectors, the signals carried by the connector will be distorted and the apparatus responding to the signal might malfunction.

SUMMARY

The present invention provides means for overcoming the foregoing limitations and disadvantages of the known types of electrical connectors. More particularly, the present invention provides an electrical connector and method for using the same which is economical and relatively easy to manufacture and highly efficient in use.

The primary object of this invention is to provide a novel RFI and EMI shielding means for an electrical connector having relatively movable plug and receptacle means for coupling electrical cables.

An object of the invention is to provide such a shielding means formed of closely spaced wire coil turns and which is readily assembled and retained on one connector part and which coacts with another connector part to present, in assembly therewith, the electrical appearance of a solid metal coil.

Another object of the invention is to provide an RFI shielding means of electrically conductive wire stock which is wound in a helix to make a coil having closely spaced turns slanted or inclined to the axis of the helix, the coil being formed into a circle, the formed coil being resilient, compressible, and flexible.

A still further object of the invention is to provide a circular coil as above described which is carried by an electrical connector in such a manner that contact surfaces on the connector parts are effectively wiped by the coil during assembly to remove oxidation on such contact surface.

A further object of the invention is to provide such a circular compressible coil for RFI shielding wherein, in assembly, the slant of the spaced coil turns progressively increases during compression in a radial outward direction to decrease space between turns until virtually line to line touching contact of adjacent turns occurs.

In the embodiment of the invention disclosed herein, the electrical connector and method for using the same includes a receptacle having current-carrying cable insertible into a plug having a current-carrying cable and the cables are interconnected providing electrical connection therebetween. An endless circular coil having closely spaced turns at an angle to a tangent of the coil, when uncompressed, is inserted into an annular groove on the plug prior to insertion of the receptacle. When the receptacle is inserted into the plug, the coil is compressed in a radial direction thereby reducing the spacing between the turns and increasing their slant and wiping along the contacting surfaces of the plug groove and receptacle to present electrically the appearance of a solid coil and to minimize radio frequency and electromagnetic interferences particularly in high frequency ranges.

DRAWINGS

DESCRIPTION

Figures 1, 2, 3, 4, 5:
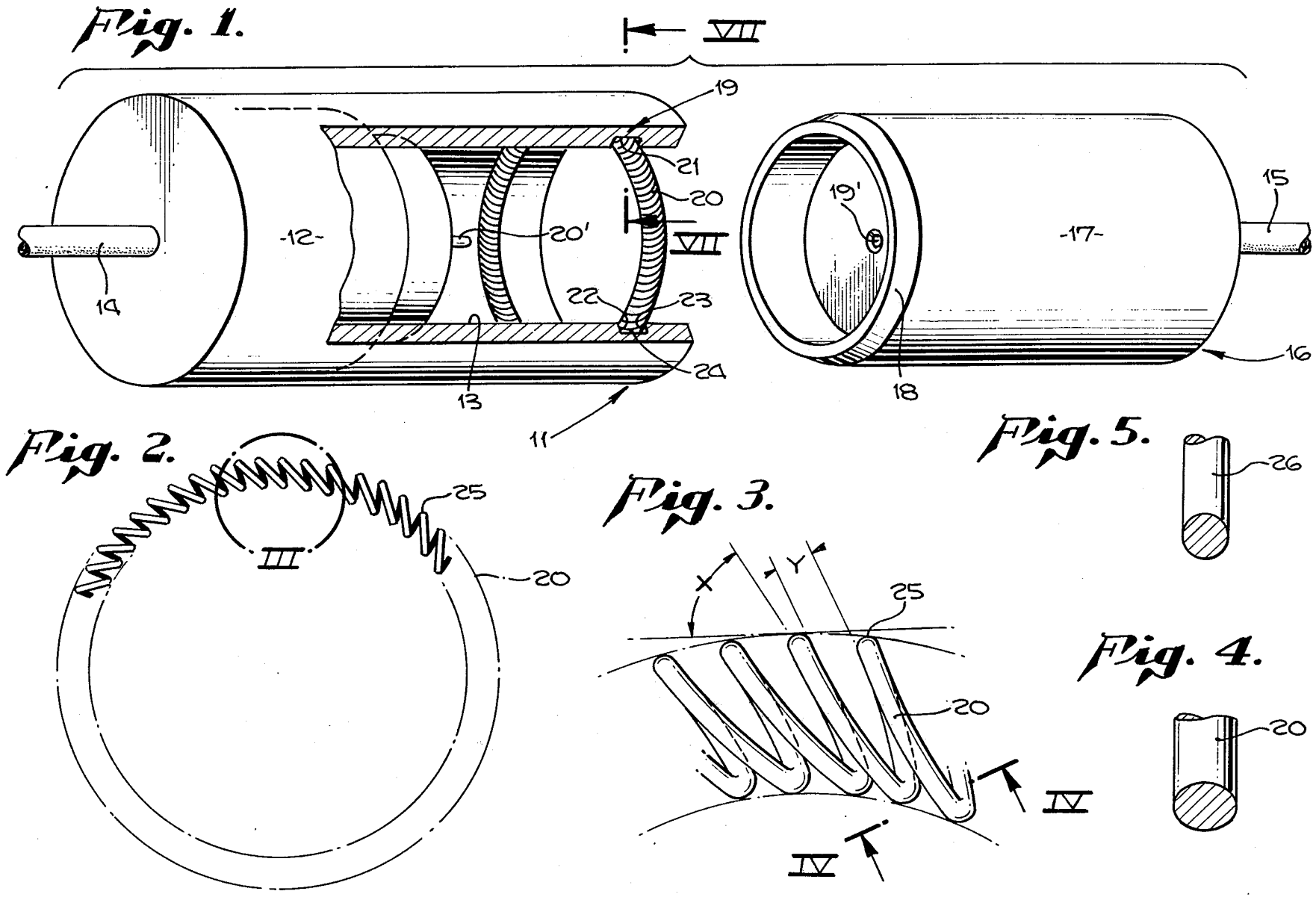
FIG. 1 is an exploded view, partly in section, of an electrical connector in accordance with the invention.
FIG. 2 is a side view of the coil alone of the connector of FIG. 1.
FIG. 3 is an enlarged detail view of a portion of the coil of FIG. 2 taken at the portion of the coil indicated by the phantom circle at III.
FIG. 4 is a cross-sectional view of the coil of FIGS. 2 and 3 taken along plane IV—IV of FIG. 3.
FIG. 5 is a cross-sectional view, similar to FIG. 4, showing an alternate cross-section of the coil of FIGS. 2 and 3.

Referring to the drawings in more detail and particularly to FIG. 1, the present invention is particularly adapted to be embodied in the electrical connector 10 illustrated in FIG. 1. Electrical connector 10 shows a plug 11, which may be of any suitable configuration, but preferably has a generally outer cylindrical wall surface 12 and an inner generally cylindrical wall surface 13. The particular wall thickness and dimensions of plug 11 is a matter of choice depending on the desired use and capacity of connector 10. A current-carrying cable 14 is shown leading into plug 11. Cable 14 may carry therein one or more current-carrying wires and plug 11 may include suitable means (not shown) on the interior thereof for individually connecting individual wires in cable 14 to individual wires of cable 15 carried by receptacle 16. Such interconnection forms no part of this invention and thus further description and/or illustration is deemed unnecessary. Suitable interconnecting means are well-known in the art, such as that described in U.S. Pat. No. 3,848,950. Further, although the terms "plug" and "receptacle" have been used, such terms are used only for convenience and may be used interchangeably.

Receptacle 16 may also have a generally cylindrical outer wall 17 of a diameter slightly less than the diameter of inner wall surface 13 of plug 11. Optionally, the forward leading peripheral edge 18 of receptacle 16 may be chamfered, as shown. The foregoing has described a conventional plug and receptacle which may be mated by insertion of receptacle 16 into plug 11 into a close sliding fit with inner wall surface 13. An exemplary single contact socket 19′ is shown in receptacle 16 to receive a single contact pin 20′ on plug 11 to complete the electrical connection between cable 14 and cable 15. Of course, a plurality of pins and sockets may be provided for interconnecting individual wires as discussed in the aforementioned U.S. Pat. No. 3,848,950.

As particularly contemplated within the present invention, interconnecting means 19 are provided for shielding against and minimizing transmission of RFI and EMI signals through connector 10. In the exemplary embodiment of the invention, such interconnecting means 19 includes a circular resilient compressible flexible coil 20 of wire stock (see also FIG. 2) which is disposed in an inner peripheral annular groove 21 formed in inner wall surface 13 of plug 11. Groove 21 may be of any suitable cross-sectional configuration, such as having parallel side walls 22, 23 interconnected by a back wall 24 and generally rectangular in cross-section. However, as will be discussed, the depth of groove 21 is slightly less than the outer diameter of turns of coil 20 so that the inner circumferential portions of coil 20, in its uncompressed state, extend slightly into the path of receptacle 16. Thus, coil 20 is confined and retained within groove 21 and adapted to be engaged by receptacle 16 when the receptacle is inserted into plug 11.

Coil 20 is shown in side view in FIG. 2, in detail in FIG. 3 and in cross-section in FIG. 4. Coil 20 is an endless circular loop having a plurality of spaced helical coil turns 25 (see FIGS. 2 and 3). Each turn 25 is slanted or inclined with respect to the axis of the helix, as shown in FIG. 3. The plane of each turn 25 is at an angle X of between about 35° to 55°, 45° being preferred, from a tangent to the outer circumference of the circular loop. The spacing between successive turns is very small; e.g., the turns 25 are closely spaced such as a distance Y of between about 0.010 and 0.020 inches. Spacing Y and angle X indicate the condition of coil 20 when coil 20 is in the uncompressed state; i.e., when coil 20 is positioned in assembly in groove 21 as shown in FIG. 1 prior to mating of receptacle 16.

As shown in FIG. 4, the wire stock of coil 20 may be oval in cross-section. FIG. 5 shows another embodiment of coil 20 wherein the coil 26 of FIG. 5 may be circular in cross-section. Coil 20 may be of a suitable electrically conductive material, such as heat treated berylium copper wire. The wire stock of coil 20, if circular in cross-section as in FIG. 5, may be about 0.01 inches in diameter. The oval wire stock of coil 20 may be similar in dimensions. Coil 20 may be about 0.62 inches in outer diameter for a size 10 shell (shell diameters vary; e.g., a size 10 shell has an O.D. of 0.620 inch; a size 24 shell has an O.D. of 1.495 inches). The outer diameter (FIG. 2) of turns of coil 20 may be about 0.07 inches. Of course, such dimensions depend upon the dimensions of plug 11 and receptacle 16 and may vary accordingly. Such suggested materials and dimensions and the slant of the turns and spacing therebetween of coil 20 also apply to coil 26 shown in cross-section in FIG. 5.

Figure 7:
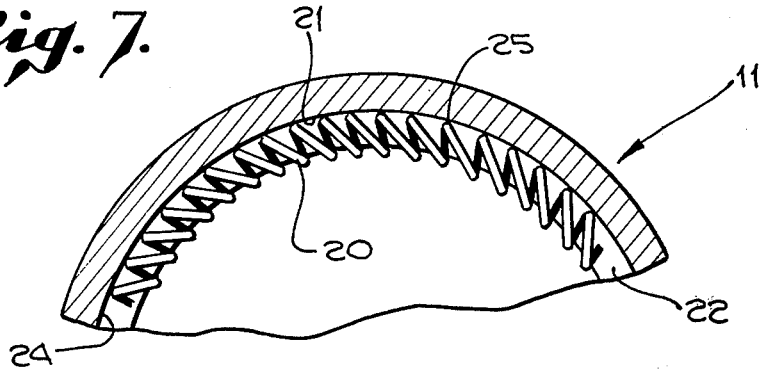
FIG. 7 is an enlarged cross-sectional view of a portion of the connector of FIG. 1 taken along plane VII—VII thereof.

A coil 20 formed into a circular loop is readily and quickly assembled with annular groove 21 by radially compressing a portion of coil 20 to permit insertion within the plug shell. At the groove 21, the coil is released from compression to allow the coil to expand into the groove and to seat itself against the back wall 24. In seated position, the coil 20 is retained in assembly with groove 21 by the resilient characteristic of the wire stock. The inner circumferential portion of coil 20 extends slightly radially inwardly of the plug wall surface 13 and in such position may be said to "float" or be yieldable in a radial direction in the chamber of the plug adjacent wall surface 13 (FIG. 7). The outer diameter of coil 20, seated against back wall 24, does not change.

Figure 6:
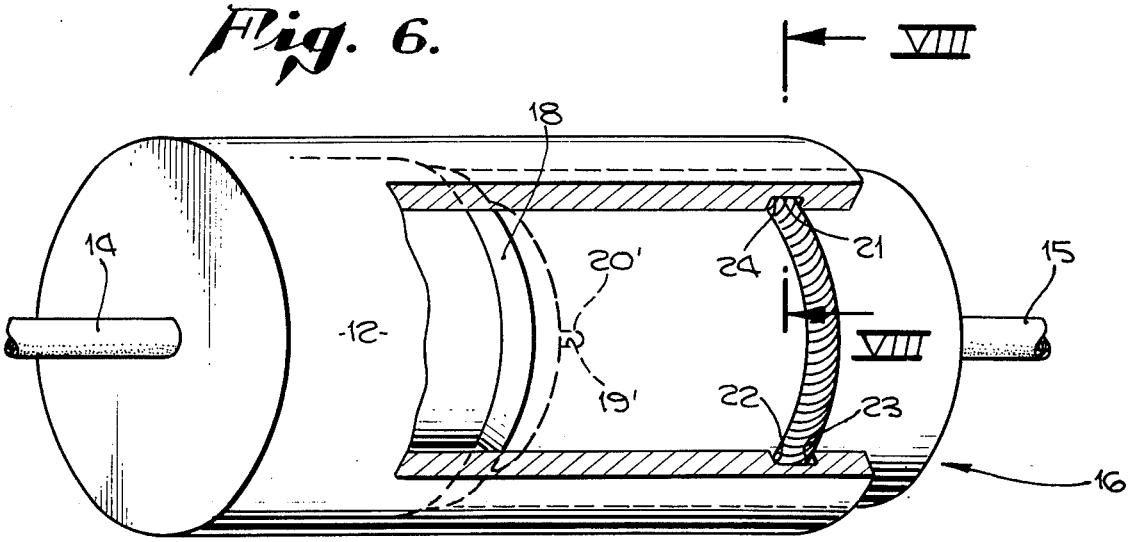
FIG. 6 is an assembled view, partly in section, of the connector of FIG. 1.
Figure 8:
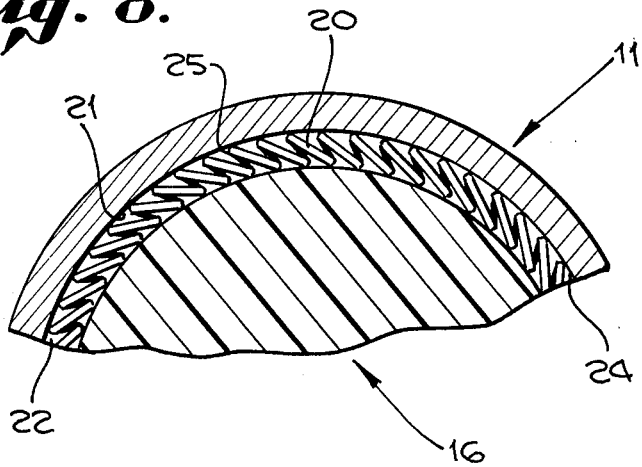
FIG. 8 is an enlarged cross-sectional view of a portion of the assembled connector of FIG. 6 taken along plane VIII—VIII thereof.

As shown in FIG. 6, when receptacle 16 is inserted into plug 11, pin 20′ on plug 11 enters socket 19′ on receptacle 16 to interconnect cable 14 with cable 15 as is well known in the art. As receptacle 16 moves into plug 11, the chamfered edge 18, which has a leading reduced outer diameter, passes readily into the opening of coil 20. As the coil 20 slides on the chamfered edge 18, the coil is progressively radially compressed outwardly toward and against the back wall 24 of groove 21. As the coil 20 slides on chamfered edge 18 and the inner circumference of the coil is expanded radially, the coil turns 25 increase their slant angle and simultaneously diametrically deflect each turn of the coil 20, as shown in FIG. 8. As the turns 25 are deflected, the movement of turns 25 provides a wiping action on the sides 22, 23 and bottom or back wall 24 of groove 21 as well as on the contacting surfaces of receptacle 16. The diametric deflection of turns 25 provides a radially outwardly and inwardly directed pressure against the mating plug 11 and receptacle 16. The wiping action removes any oxidation on the wiped surfaces and the radially directed pressures provide an effective electrical interface between the plug 11 and receptacle 16.

The surfaces of groove 21 and the cylindrical surface of the receptacle shell may be coated with an electrically conductive material such as gold, silver, or other noble metals.

As described above the spacing of coil turns in unassembled condition is about 0.010 to 0.020 inches. After assembly of the plug and receptacle means, the shifting of the coil turns into a more inclined position and the radial compression of the coil in the groove, causes the coil turns to be closer to each other and may be in the order of line to line contact of the turns up to about 0.005 inches spacing between turns. Such reduced spacing between coil turns minimizes RFI and EMI electrical leakage or transmission windows or openings through coil 20. The coil 20 in such assembly presents electrically the appearance of a solid coil.

The foregoing arrangement of the coil 20 in groove 21 increases the RFI and EMI shielding of connector 10, is simple to fabricate and install and less prone to damage both in factory and field operation. The discussion hereinabove with respect to the oval cross-section of wire of coil 20 is also applicable to the circular cross-section of coil 26 of FIG. 5. It should be noted that the oval wire stock is wound into a coil 20 with the major axis of the oval lying generally parallel or in the same direction as the axis of the turn and the minor axis in a radial direction. The outer circumference of the coil 20 contacts the surfaces of groove 21 and wall 17 of the receptacle along convex faces having a greater included angle than other face portions of the wire of the coil.

All changes and modifications coming with the scope of the appended claims are embraced thereby.

I claim:

1. In an electrical connector including a first connector member adapted to mate with a second connector member, the combination of:

said first connector member having a cylindrical wall including internal cylindrical surfaces, a radially inwardly facing groove in said internal cylindrical surface, said groove having a bottom wall of selected diameter and side walls spaced apart a selected distance;

said second connector member having an external cylindrical surface having an outer diameter to provide a close sliding fit with said internal cylindrical surfaces and having a beveled leading edge;

and a continuous helical spring formed in a closed circular loop, retained in said groove, and held against movement in axial and radially outward directions by said walls of said groove;

the outer circumference of said circular loop being seated against said bottom wall of said groove, the inner circumference of said circular loop being less than the outer circumference of the external cylindrical surface on said second connector member, said continuous helical spring having helical coils each having an outer diameter to closely fit within said groove with sliding contact with said side walls and bottom wall, said continuous helical spring loop being non-compressible in an axial direction and being subject to forces in a radial outward direction when said second connector member is mated with said first connector member, whereby said helical coils are displaced in a circumferential direction into a greater slant relation with the outer circumference of the circular loop during such mating of the connector members to close space between adjacent helical coils to provide an effective shield against RFI and EMI transmission, and whereby the radial outward forces acting on said helical coils during relative sliding movement of the connector members causes wiping contact of the coils with side walls and bottom wall of the group and with said external cylindrical surface of said second connector member.

2. In a connector as claimed in claim 1 wherein said helical coils are formed of wire having an oval cross-sectional configuration, the major axis of said oval configuration lying parallel to the axis of said first connector member.

* * * * *